US012690666B2

(12) United States Patent
Chen

(10) Patent No.: US 12,690,666 B2
(45) Date of Patent: Jul. 28, 2026

(54) EASY-TO-TRANSPORT ASSEMBLED TABLE

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 76 days.

(21) Appl. No.: 18/527,306

(22) Filed: Dec. 3, 2023

(65) Prior Publication Data

US 2025/0176705 A1 Jun. 5, 2025

(51) Int. Cl.
*A47B 3/06* (2006.01)
*A47B 13/02* (2006.01)

(52) U.S. Cl.
CPC ..... *A47B 3/06* (2013.01); *A47B 13/02* (2013.01)

(58) Field of Classification Search
CPC ..... A47B 3/06; A47B 13/02; A47B 37/04
See application file for complete search history.

(56) References Cited

U.S. PATENT DOCUMENTS

| | | | | |
|---|---|---|---|---|
| 7,296,522 | B1 * | 11/2007 | Mahmalji | A47B 37/04 108/50.13 |
| 8,418,633 | B1 * | 4/2013 | Lee | A47B 13/003 108/157.15 |
| 11,849,838 | B1 * | 12/2023 | Yang | A47B 13/06 |
| 2011/0239912 | A1 * | 10/2011 | Palese | A47B 1/08 108/85 |
| 2025/0143450 | A1 * | 5/2025 | Chen | A47B 37/04 |

FOREIGN PATENT DOCUMENTS

| | | | | |
|---|---|---|---|---|
| CN | 103330421 | A | 10/2013 | |
| CN | 210276324 | U | 4/2020 | |
| CN | 211820274 | U | 10/2020 | |
| CN | 217851817 | U * | 11/2022 | A47B 3/06 |
| CN | 115556809 | A * | 1/2023 | |
| KR | 20170014233 | A * | 2/2017 | |

* cited by examiner

*Primary Examiner* — Matthew W Ing
(74) *Attorney, Agent, or Firm* — Nitin Kaushik

(57) ABSTRACT

A detachable-to-transport assembled table is described. The table includes table legs disposed at each of four corners of a lower end surface of a table top and fixed by bolts, where the table top is assembled by at least one first table plate. The easy-to-transport assembled table enables convenient transport and carrying by reducing the overall size of the table.

8 Claims, 11 Drawing Sheets

EASY-TO-TRANSPORT ASSEMBLED TABLE

TECHNICAL FIELD

The present invention relates to the technical field of tableware, in particular to an easy-to-transport assembled table.

BACKGROUND

At present, existing tables on the market are all of an integral structure or a structure with detachable table plates and table legs. However, due to the large size of the entire table plate, the process of transportation and carrying is time-consuming and laborious, causing a high transportation cost of products; for the table plate of the table having the structure with detachable table plates and table legs, users need to install the table plate by themselves. Further, the large table plate is heavy and easy to collide during installation, making the installation process time-consuming and laborious.

For example, Chinese utility model patent CN215583395U discloses an outdoor table capable of being quickly assembled, including a support plate mechanism, where a folding mechanism is movably connected to a bottom of the support plate mechanism, and an adjusting mechanism is sleeved on an outer surface of the folding mechanism. During use, the table can be quickly assembled and supported by the folding mechanism, and meanwhile, the height of the table can be adjusted according to needs by the adjusting mechanism. However, the table has an integral table top which is large in area and not easy to transport.

Therefore, the present applicant provides an easy-to-transport assembled table, for solving the problems raised in the above background.

SUMMARY

The present invention aims to provide an easy-to-transport assembled table, which solves the technical problem that due to a relatively large overall size, an existing table is inconvenient to transport, and is inconvenient for a user to carry when the user goes out.

In order to solve the above technical problem, the present invention provides an easy-to-transport assembled table, including table legs disposed at each of four corners of a lower end surface of a table top and fixed by bolts, where the table top is assembled by at least one first table plate.

A further improvement of the technical solution of the present invention is that: the table top consists of the first table plate and a second table plate which are same in size, where the first table plate and the second table plate include frames and a rectangular panel surrounded and welded inside peripheries of the frames, a plurality of bolt holes are disposed in an assembled side edge of the frame, and the first table plate and the second table plate are assembled to form the table top by the bolt holes and the bolts.

A further improvement of the technical solution of the present invention is that: top surfaces of the frames and a top surface of the rectangular panel are located in the same plane, bottom surfaces of the frames are higher than a bottom surface of the rectangular panel, and the frames and the bottom surface of the rectangular panel form a storage cavity in a surrounding manner.

A further improvement of the technical solution of the present invention is that: threaded holes A are disposed in a bottom surface of a side edge where the first table plate and the second table plate are assembled and in top ends of connecting pipes, respectively, the connecting pipes are fixedly connected with the first table plate and the second table plate by the bolts and the threaded holes A, and the connecting pipes are used for assembling and reinforcing the first table plate and the second table plate.

A further improvement of the technical solution of the present invention is that: two connecting pipes are disposed in a front-and-rear symmetrical manner, making the assembled table plates more stable.

A further improvement of the technical solution of the present invention is that: a connecting member is welded and disposed on each of four corners of a bottom surface of the table top, where threaded holes B are disposed in a bottom surface of the connecting member and a top surface of each table leg, respectively, and the table legs 4 are fixed to bottom surfaces of the connecting members by the bolts and the threaded holes B.

A further improvement of the technical solution of the present invention is that; a length of each table leg is less than a width of the storage cavity, facilitating storage of the table legs in the storage cavity.

A further improvement of the technical solution of the present invention is that: a through-hole is disposed in a middle part of the table top for installing and placing an outdoor sunshade.

A further improvement of the technical solution of the present invention is that: a square reinforcement frame is disposed below the table top, where a threaded hole C is disposed in the square reinforcement frame, the square reinforcement frame is fixed to a middle part of each table leg by the bolts and the threaded hole C, and two side edges of the square reinforcement frame are fixedly connected with the connecting pipes by the bolts.

A further improvement of the technical solution of the present invention is that; a bracket is disposed at a middle part of the square reinforcement frame, where threaded holes D are disposed in a front end and a rear end of the bracket, the bracket is connected with the square reinforcement frame by the threaded holes D and the bolts, and a through-hole A is disposed in a middle part of the bracket for reinforcing and supporting a sunshade.

The present invention has the following beneficial effects after adopting the above-mentioned technical solution:

1. according to an easy-to-transport assembled table provided by the present invention, the table top is split into a plurality of table plates, transported to the user's home, and then assembled. The table plate has a relatively small area, thus facilitating packaging and transportation, and reducing the transportation cost of the product.

2. According to an easy-to-transport assembled table provided by the present invention, the bottom surface of the table plate is provided with a storage cavity capable of storing parts such as a table leg, a bracket and a connecting pipe, and since the parts such as the table leg, the bracket and the connecting pipe are placed inside the table plate, both the space occupied by the table in the process of transportation and the transportation cost are reduced.

3. According to an easy-to-transport assembled table provided by the present invention, through-holes are disposed in the table top and a fixed frame for placing a sunshade pole, facilitating the user to place a sunshade for shading when using the table outdoors, and the two through-holes on the top and bottom further enhance the stability of the sunshade, which is extremely convenient to use.

BRIEF DESCRIPTION OF DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Reference numbers in the accompanying drawings: 1—first table plate; 2—second table plate; 3—table top; 4—table leg; S-frame; 6—rectangular panel; 7—storage cavity; 8—connecting pipe; 9—connecting member; 10—through-hole; 11—square reinforcement frame; 12—bracket; 13—through-hole A; 14—bolt hole; 15—threaded hole A; 16—threaded hole B; 17—threaded hole C; 18—threaded hole D.

DETAILED DESCRIPTION OF EMBODIMENTS

An explicit and complete description of the technical solution in the present invention is given below in conjunction with the accompanying drawings. Apparently, the described embodiments are part of the embodiments of the present invention, not all of the embodiments. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Figure 1:
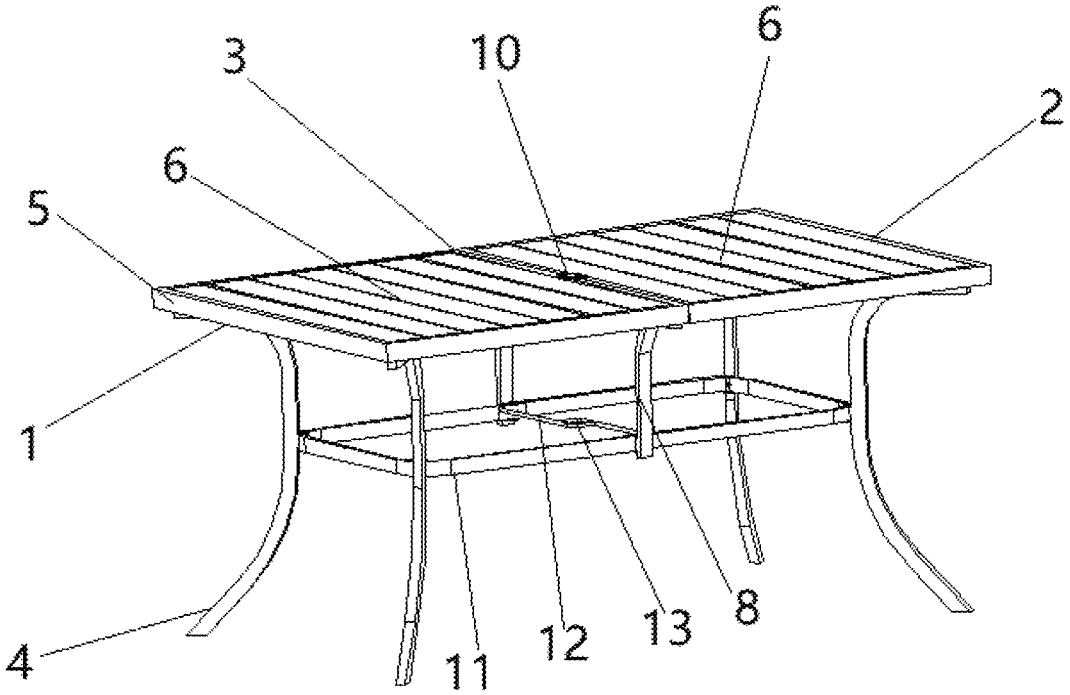
FIG. 1 is a schematic diagram of a three-dimensional structure of an easy-to-transport assembled table provided by the present invention.
Figure 2:
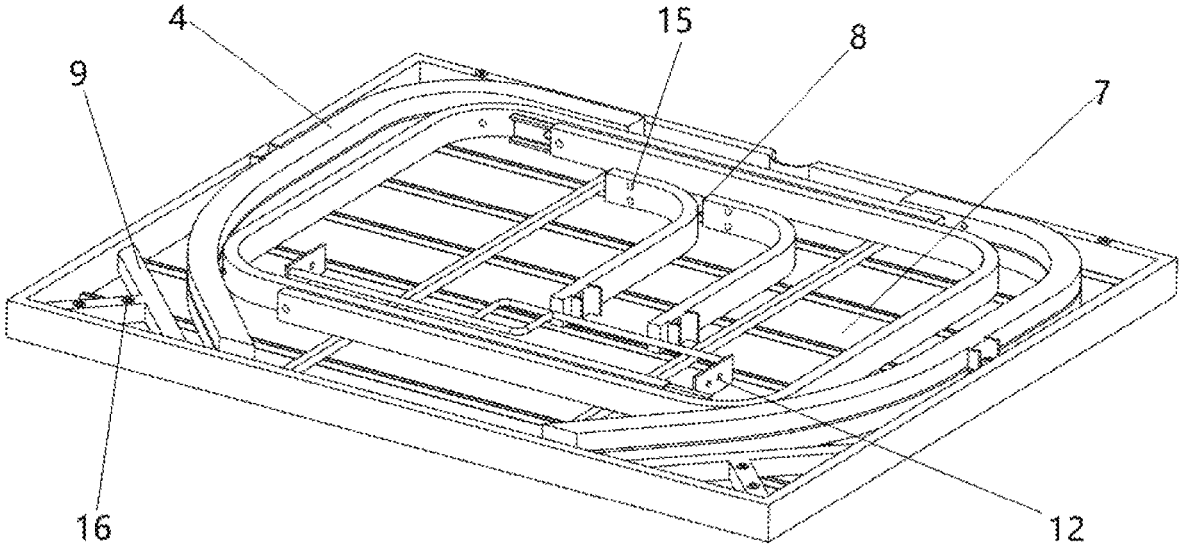
FIG. 2 is a schematic structural diagram of storing of a storage cavity in FIG. 1.
Figure 3:
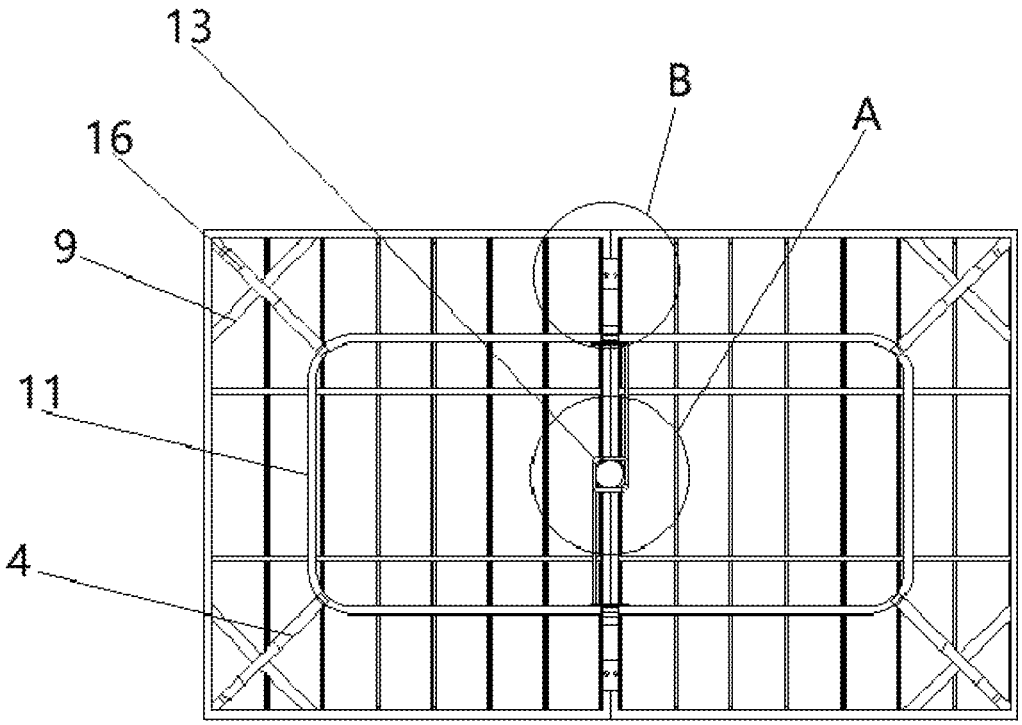
FIG. 3 is a bottom view of the assembled table in FIG. 1.
Figure 4:
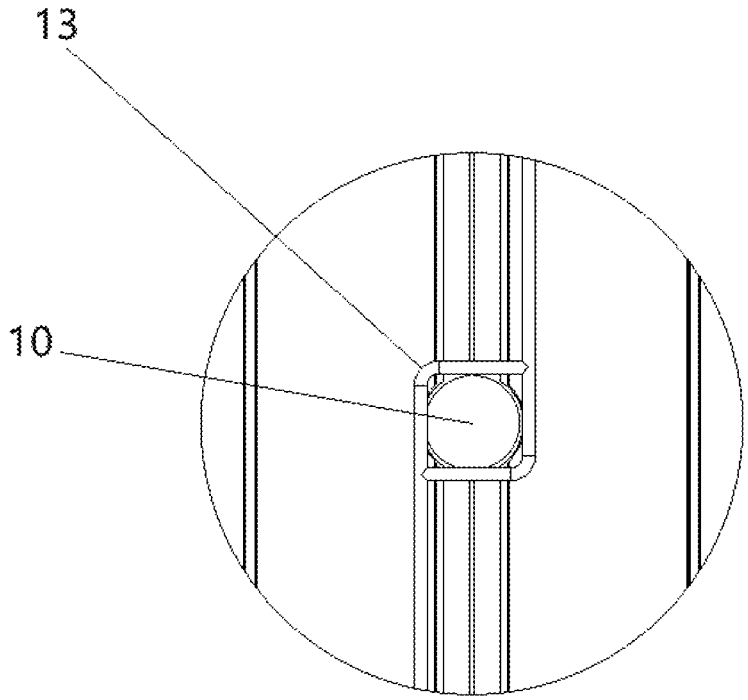
FIG. 4 is a partial enlarged view of a part A in FIG. 3.
Figure 5:
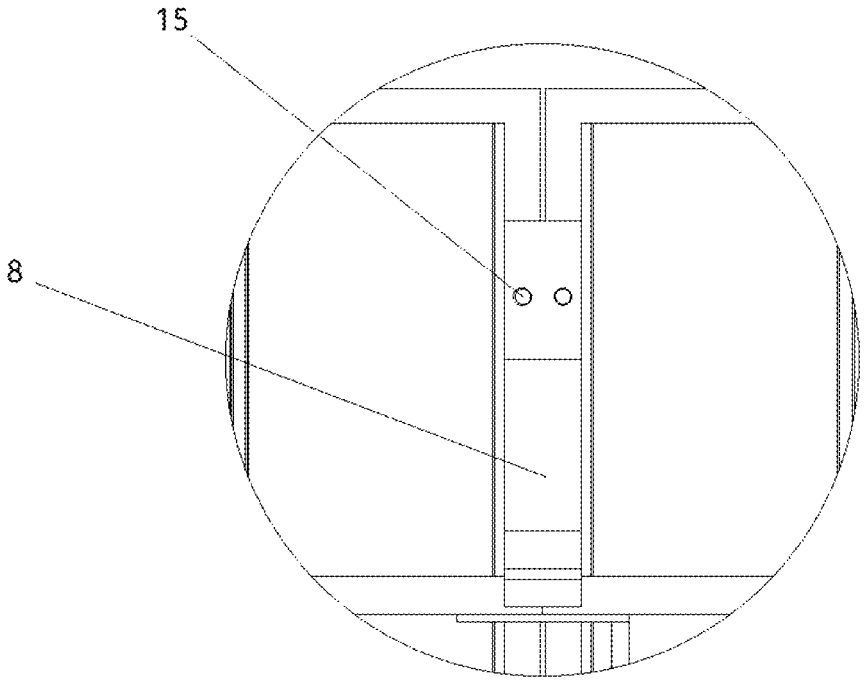
FIG. 5 is a partial enlarged view of a part B in FIG. 3.
Figure 6:
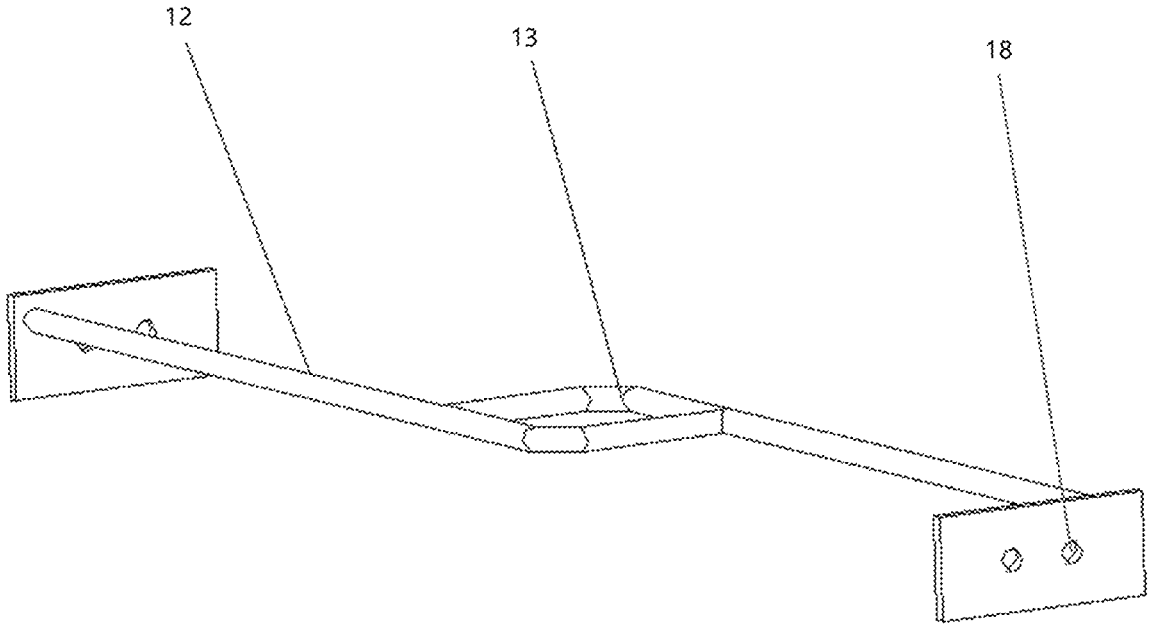
FIG. 6 is a schematic structural diagram of a bracket in FIG. 1.
Figure 7:
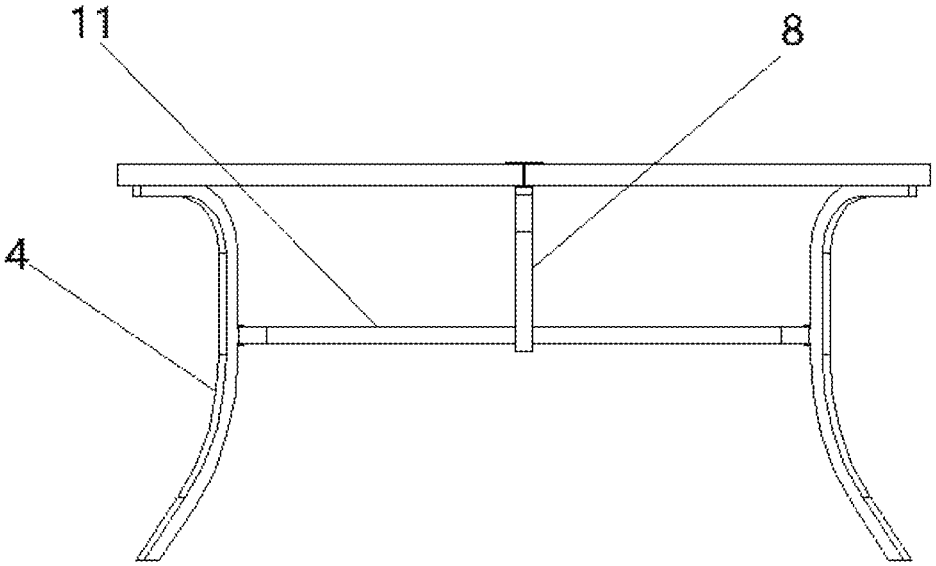
FIG. 7 is a side view of the assembled table in FIG. 1.
Figure 8:
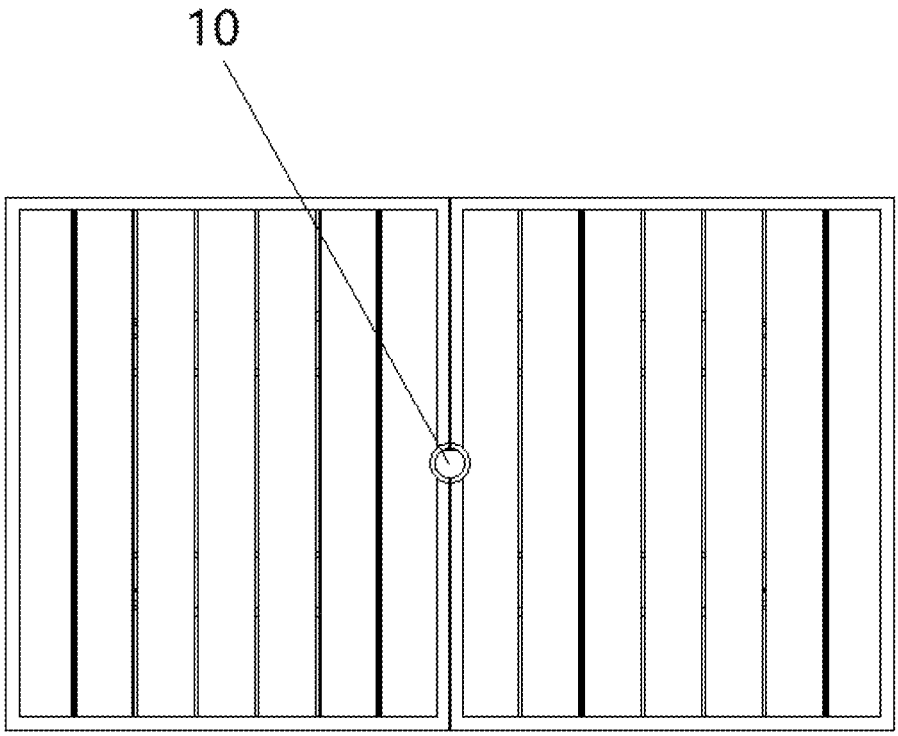
FIG. 8 is a top view of the assembled table in FIG. 1.
Figure 9:
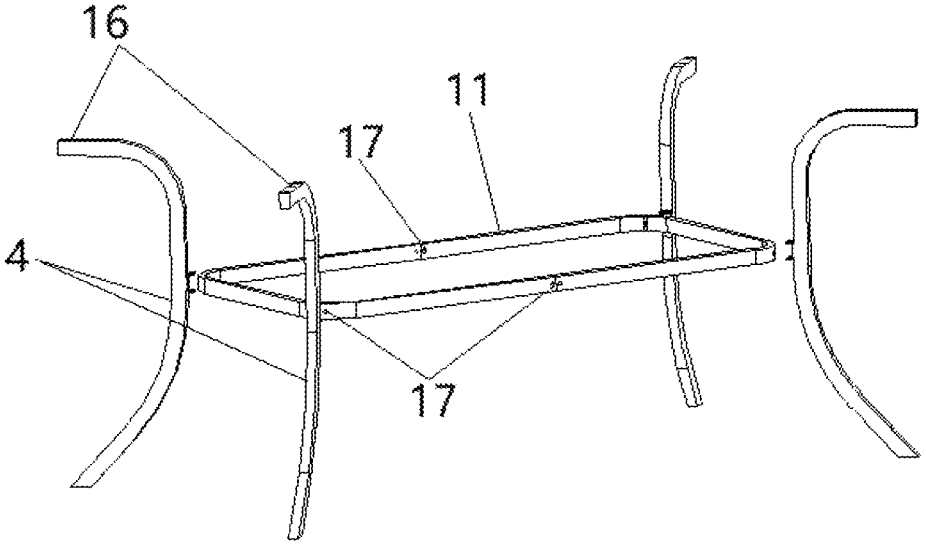
FIG. 9 is an exploded diagram of table legs and a square reinforcement frame.
Figure 10:
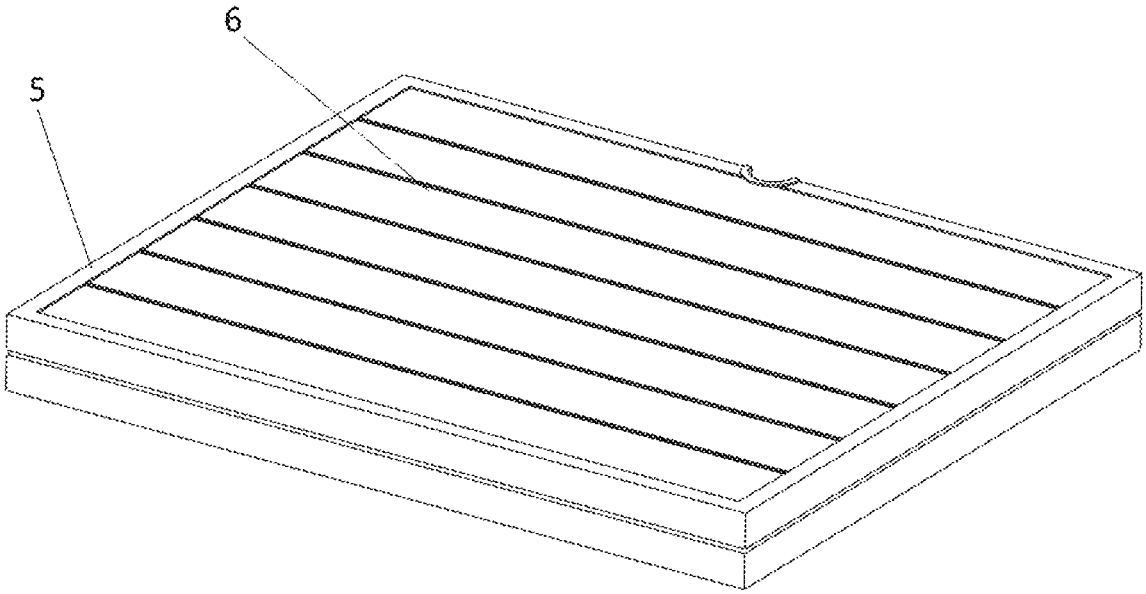
FIG. 10 is a schematic structural diagram up-and-down folding of two storage cavities in FIG. 2.
Figure 11:
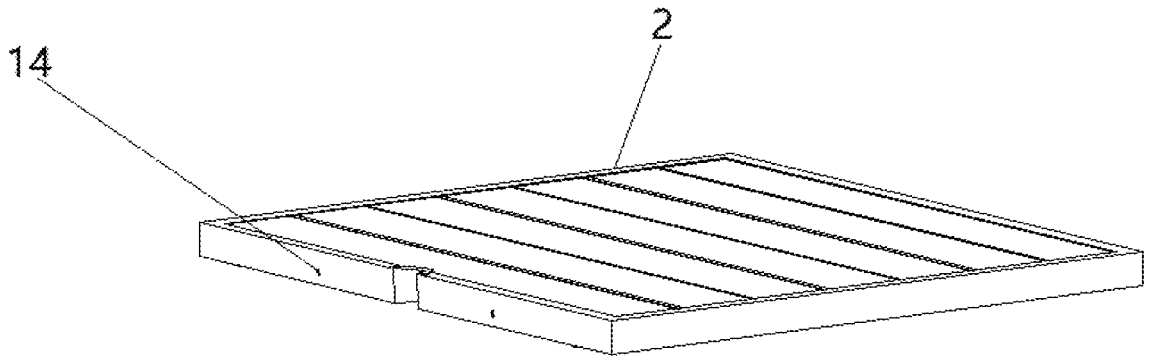
FIG. 11 is a schematic structural diagram of bolt holes of the table plate in FIG. 1.

As shown in FIGS. 1-8, the present embodiment provides an easy-to-transport assembled table, including table legs 4 disposed at each of four corners of a lower end surface of the table top 3 and fixed by bolts, where the table top 3 is assembled by at least one first table plate 1; the table top is formed by assembling the first table plate 1 and a second table plate 2 which are same in size, the first table plate 1 and the second table plate 2 include frames 5 and a rectangular panel 6 surrounded and welded inside peripheries of the frames 5, a plurality of bolt holes 14 are disposed in an assembled side edge of the frame 5, and the first table plate 1 and the second table plate 2 are assembled to form the table top 3 by the bolt holes 14 and the bolts, which is convenient for assembly and disassembly; top surfaces of the frames 5 and a top surface of the rectangular panel 6 are located in the same plane, bottom surfaces of the frames 5 are higher than a bottom surface of the rectangular panel 6, the frame 5 and the bottom surface of the rectangular panel 6 form a storage cavity 7 in a surrounding manner, and the two table plates can be stacked for transportation, which is conducive to allocating the occupied space for transportation and reducing the cost of transportation; threaded holes A 15 are disposed in a bottom surface of a side edge where the first table plate 1 and the second table plate 2 are assembled and in top ends of the connecting pipes 8, respectively, the connecting pipes 8 are fixedly connected with the first table plate 1 and the second table plate 2 by the bolts and the threaded holes A, the connecting pipes 8 are used for assembling and reinforcing the first table plate 1 and the second table plate 2, each connecting pipe 8 is a square pipe or a circular pipe, and two connecting pipes 8 are disposed in a front-and-rear symmetrical manner, making the assembled table plates more stable; the first table plate 1 and the second table plate 2 include the frames 5 and the rectangular panel 6 welded to inner sides of the frames 5; top surfaces of the frames 5 and a top surface of the rectangular panel 6 are located in the same plane, bottom surfaces of the frames 5 are higher than a bottom surface of the rectangular panel 6, and the frames 5 and the bottom surface of the rectangular panel 6 form a storage cavity in a surrounding manner; and the storage cavities 7 can store the table legs and other parts, and the storage cavities 7 of the two table plates are buckled against each other to form a complete box, making space allocation more reasonable.

In the present embodiment, a connecting member 9 is welded and disposed on each of four corners of the table top 3, threaded holes B 16 are disposed in a bottom surface of the connecting member 9 and a top surface of each table leg 4, respectively, the table legs 4 are fixed to a bottom surface of the connecting member 9 by the bolts and the threaded holes B 16, and users can freely install and disassemble the table legs 4 through threads, making it convenient for the user to carry; a length of each table leg 4 is less than a width of the storage cavity 7, facilitating storage of the table legs 4 in the storage cavity 7; a through-hole 10 is disposed in a middle part of the table top 3 for installing and placing an outdoor sunshade; and a square reinforcement frame 11 is disposed below the table top 3, a threaded hole C 17 is disposed in the square reinforcement frame 11, the square reinforcement frame 11 is fixed to a middle part of each table leg 4 by the bolts and the threaded bole C 17, respectively, and two side edges of the square reinforcement frame 11 are fixedly connected with the connecting pipes 8 by the bolts. A bracket 12 is disposed at a middle part of the square reinforcement frame 11, where threaded holes D 18 are disposed in a front end and a rear end of the bracket 12, the bracket 12 is connected with the square reinforcement frame 11 by the threaded hole D 18 and the bolts, and a through-hole A 13 is disposed in a middle part of the bracket 12, for reinforcing and supporting a sunshade. When users use the table outdoors, they can insert a bracket of the sunshade into the through-hole 10 and the through-hole A 13, making the sunshade stand in the middle of the table for shading.

Finally, it should be noted that, the above-mentioned embodiments are only used to illustrate the technical solution of the present invention, not to act as a limitation; although the present invention is described in detail with reference to the foregoing embodiments, those of ordinary skill in the art should understand that: it is still possible to modify the technical solution documented in the foregoing embodiments, or to make equivalent substitutions for part or all of the technical features therein; and these modifications or substitutions do not make the essence of the corresponding technical solution deviate from the scope of the technical solution described by embodiments of the present invention.

What is claimed is:

1. A detachable-to-transport assembled table, comprising table legs (4) disposed at each of four corners of a lower end surface of a table top (3) and fixed, wherein the table top (3) is assembled by at least one first table plate (1), and the first table plate (1) comprises frames (5) and a rectangular panel (6);

wherein top surfaces of the frames (5) and a top surface of the rectangular panel (6) are located in the same plane, bottom surfaces of the frames (5) are higher than a bottom surface of the rectangular panel (6), and the frames (5) and the bottom surface of the rectangular panel (6) form a storage cavity (7) in a surrounding manner, wherein a rectangular reinforcement frame (11) is disposed below the table top (3), a threaded hole C (17) is disposed in the rectangular reinforcement frame (11), the rectangular reinforcement frame (11) is directly fixed to a middle part of each table leg (4) by the threaded hole C (17), respectively, and two side edges of the rectangular reinforcement frame (11) are fixedly connected with connecting pipes (8), the rectangular reinforcement frame (11) is detachably placed in the storage cavity (7);

wherein a bracket (12) is disposed at a middle part of the rectangular reinforcement frame (11), threaded holes D (18) are disposed in a front end and a rear end of the bracket (12), the bracket (12) is connected with the rectangular reinforcement frame (11) by the threaded holes D (18), and a through-hole A (13) is disposed in a middle part of the bracket (12) for reinforcing and supporting a sunshade;

wherein the storage cavity (7) is configured to accommodate all of the table legs (4), the connecting pipes (8), the rectangular reinforcement frame (11), and the bracket (12); and when all of the table legs (4), the connecting pipes (8), the rectangular reinforcement frame (11), and the bracket (12) are accommodated within the storage cavity (7), the rectangular reinforcement frame (11) surrounds the connecting pipes (8) and bracket (12) on the outside, and the table legs (4) surround the rectangular reinforcement frame (11) on the outside; and wherein a length of each of the table legs (4) is less than a width of the storage cavity (7).

2. The detachable-to-transport assembled table according to claim 1, wherein the table top (3) is formed by assembling the first table plate (1) and a second table plate (2) which are same in size, each of the first table plate (1) and the second table plate (2) comprises the frames (5) and the rectangular panel (6) surrounded and welded inside peripheries of the frames (5), a plurality of bolt holes (14) are disposed in assembled side edges of the frames (5) of the first table plate (1) and the second table plate (2), and the first table plate (1) and the second table plate (2) are assembled to form the table top (3) by the bolt holes (14).

3. The detachable-to-transport assembled table according to claim 2, wherein threaded holes A (15) are disposed in a bottom surface of a side edge where the first table plate (1) and the second table plate (2) are assembled and in top ends of connecting pipes (8), respectively, the connecting pipes (8) are fixedly connected with the first table plate (1) and the second table plate (2) by the threaded holes A (15), and the connecting pipes (8) are used for assembling and reinforcing the first table plate (1) and the second table plate (2).

4. The detachable-to-transport assembled table according to claim 3, wherein each connecting pipe (8) is a rectangular pipe, and two connecting pipes (8) are disposed in a front-and-rear symmetrical manner, making the assembled table plates more stable.

5. The detachable-to-transport assembled table according to claim 1, wherein a connecting member (9) is welded and disposed on each of four corners of a bottom surface of the table top (3), threaded holes B (16) are disposed in a bottom surface of the connecting member (9) and a top surface of each table leg (4), respectively, and the table legs (4) are fixed to a bottom surface of the connecting member (9) by the threaded holes B (16).

6. The detachable-to-transport assembled table according to claim 5, wherein a length of each table leg (4) is less than a width of a storage cavity (7), facilitating storage of the table legs (4) in the storage cavity (7).

7. The detachable-to-transport assembled table according to claim 1, wherein a through-hole (10) is disposed in a middle part of the table top (3) for installing and placing the sunshade.

8. The detachable-to-transport assembled table according to claim 7, wherein the through-hole (10) in the table top (3) and the through-hole A (13) in the bracket (12) are configured to receive a bracket of the sunshade.

* * * * *